US007500807B2

(12) United States Patent
Schmitt

(10) Patent No.: US 7,500,807 B2
(45) Date of Patent: Mar. 10, 2009

(54) METHOD OF CONSTRUCTION USING SHEET PILING SECTIONS

(75) Inventor: Alex Schmitt, Esch-sur-Alzette (LU)

(73) Assignee: Arcelormittal Commercial s.a.r.l., Esch-Sur-Alzette (LU)

( * ) Notice: Subject to any disclaimer, the term of this patent is extended or adjusted under 35 U.S.C. 154(b) by 187 days.

(21) Appl. No.: 11/786,666

(22) Filed: Apr. 12, 2007

(65) Prior Publication Data

US 2007/0264087 A1 Nov. 15, 2007

Related U.S. Application Data

(60) Provisional application No. 60/794,678, filed on Apr. 25, 2006.

(51) Int. Cl.
*E02D 29/045* (2006.01)

(52) U.S. Cl. ..... 405/229; 405/149; 405/231; 405/233; 405/239; 52/169.9

(58) Field of Classification Search ..... 405/229, 405/231, 232, 233, 239, 134, 149; 52/169.9
See application file for complete search history.

(56) References Cited

U.S. PATENT DOCUMENTS 1,876,496 A * 9/1932 Goldsborough ..... 405/149
3,184,893 A * 5/1965 Booth ..... 405/231
5,522,676 A * 6/1996 Gryba ..... 405/149
5,944,453 A * 8/1999 Gryba ..... 405/229
6,220,789 B1 * 4/2001 White ..... 405/229

FOREIGN PATENT DOCUMENTS

JP 08199603 * 8/1996
JP 08253946 * 10/1996
WO WO2004055273 * 7/2004

OTHER PUBLICATIONS

Bruskeland, O., "Deep Basement With Permanent Sheet Pile Walls", *Technical European Sheet Piling Association*, Apr. 1991.
Skyline Steel, LLC., "The Arcelor Parking Garage System from Skyline Steel ", *Lichtenstein Consulting Engineers*, 2004.
Compact disc containing video titled, "Arcelor Parking Garage System," which shows the construction of parking garage sheet piling sections, Copyright 2004, (formatted for Windows Media Player).

* cited by examiner

*Primary Examiner*—Frederick L Lagman
(74) *Attorney, Agent, or Firm*—Hoffmann & Baron, LLP

(57) ABSTRACT

A method of construction using sheet piling sections that includes the steps of: (a) installing a sheet piling wall in the ground to enclose a first area and a second area; (b) excavating a plurality of holes in the first area; (c) excavating the second area; (d) installing a plurality of first area structural supports; (e) leveling the first area; (f) forming a first floor in the first area; (g) excavating the first area to form a first area chamber; (h) leveling the bottom surface of the first area chamber; (i) forming a first area chamber floor; (j) repeating steps (g) through (i); (k) installing a plurality of second area structural supports; (l) forming a bottom floor in the excavated second area; (m) forming a ceiling above the bottom floor to form a second area chamber; and (n) repeating step (m) until a plurality of second area chambers are formed.

26 Claims, 6 Drawing Sheets

METHOD OF CONSTRUCTION USING SHEET PILING SECTIONS

This application claims priority from provisional application Ser. No. 60/794,678, filed on Apr. 25, 2006, which is incorporated herein in its entirety.

FIELD OF THE INVENTION

The present invention relates to a method of constructing basements and/or underground parking garages for buildings, parking garages and other structures. In particular, the present invention relates to a method of constructing basements and/or underground parking garages using sheet piling sections to form the walls of the underground portion of the structure.

BACKGROUND OF INVENTION

The below ground areas of buildings and other structures have traditionally been formed by excavating a hole using a temporary retaining system on the sides and then constructing the below ground walls of the structure in the excavated hole. The size of the excavation depends on the size of the building or structure that is being constructed and concrete is typically used to form the walls and floor. This method requires concrete forms to be constructed in the excavated hole and concrete to be poured into the forms. After the concrete hardens, the forms are removed and a floor is constructed on the foundation. For larger structures, it is usually necessary to construct footings or drive foundation pilings in the excavated area to support internal columns. These footings or piled foundations require the construction of additional forms and the pouring of more concrete.

The construction of the above ground area of the building or structure cannot begin until the construction of the foundation and the below ground area of the building or structure is completed. This means that the construction of the below ground area is on the critical path of a construction schedule and any delays in constructing the below ground area results in a delay in the completion of the building or structure. Accordingly, it is desirable to find a method of constructing the below ground area of a building or structure that does not require substantial completion of below ground construction before the above ground construction can begin. Such a method would allow above ground and below ground construction to be done simultaneously and decrease the construction time and cost.

When a conventional concrete foundation is poured using concrete forms, the excavation must extend beyond the perimeter of the foundation to allow room for constructing the forms. Similarly, in the past when sheet piling walls were constructed around the perimeter of an excavation, supports had to be installed on the exterior of the walls to anchor the walls in position so that the wall would not collapse inwardly when the interior side of the wall was excavated. Typically, these anchors extended out from the exterior of the sheet piling wall several feet or more. Consequently, the property owner had to either build further in from the property line to allow room for the installation of the anchors or receive permission from adjoining land owners to install the anchors on the adjoining property. Moreover, in many cases, existing structures prohibited this method of construction. Accordingly, neither alternative was completely satisfactory and there is a need for a construction method that allows the foundation wall to be built close to a property line. In addition, there is a need for a construction method using sheet piling sections that does not require supports or anchors to be installed on the exterior walls.

Many large constructions projects include buildings of different heights and complexity that have a longer construction schedule than other buildings. In order to minimize construction time, it is usually desirable to begin construction on these buildings as soon as possible, while the construction of other buildings does not have to be expedited. Under these circumstances, it may be desirable in some areas of the site to use a method of construction that does not require substantial completion of below ground construction before the above ground construction can begin and a more conventional construction method in other areas of the site. Such a method would be highly desirable since it would provide the benefits of both methods of construction.

In particular, there is a need for a simple and efficient solution to the construction of below grade structures that permits above ground construction to begin before the underground construction is completed. There is also a need for a method that reduces the overall time for construction and lowers the cost, while maximizing the available space underground. In addition, there is a need for a method of construction that expedites construction in selected areas of a site by simultaneously constructing above and below the ground.

SUMMARY OF THE INVENTION

In accordance with the present invention, a method of construction using sheet piling sections is provided. The method includes the steps of: installing a plurality of sheet piling sections in the ground to form a wall below ground level (also referred to herein as "grade level"), which substantially encloses a first area and a second area; forming a first floor in the first area; excavating under the first floor to form an upper chamber; forming an upper chamber floor; excavating the second area to a predetermined depth; forming a bottom floor in the excavated second area; and forming a bottom chamber ceiling above the bottom floor to form a bottom chamber.

The method can include excavating under the upper chamber floor to form a lower chamber and forming a lower chamber floor so that the lower chamber floor corresponds to the bottom floor in the excavated second area. The method can also include forming a top chamber ceiling above the bottom chamber ceiling to form a top chamber so that the top chamber ceiling corresponds to the first floor in the first area. Using the method, a plurality of first area chambers can be formed between the first floor and the lower chamber floor and a plurality of second area chambers can be formed between the bottom floor and the top chamber ceiling. The first area and second area chambers are connected so that they form a plurality of continuous levels of an underground structure.

In one embodiment of the invention, after installing the plurality of sheet piling sections and prior to forming the first floor in the first area, the method includes: excavating a plurality of holes in the first area to an elevation below the predetermined depth and installing a plurality of structural supports in the plurality of holes. The plurality of structural supports provides support for the first floor and the upper chamber floor. Preferably, the excavation of the plurality of holes includes driving a plurality of casings in the first area and removing spoils (i.e., soil, rocks and other materials) from inside the casings, and the installation of the plurality of structural supports includes pouring concrete into the plurality of casings, after the spoils inside the casing are removed, to form foundations for the plurality of structural supports.

The wall formed by the sheet piling sections has an interior surface and a plurality of floor supports attached thereto. The first floor, the upper chamber floor, the bottom chamber floor and the bottom chamber ceiling at least partially contact the wall and are attached to one or more of the floor supports. The interior surface is cleaned and at least partially coated with a protective coating, such as an epoxy, after it is exposed by the excavation of the first area and the second area. The plurality of sheet piling sections interconnect with adjacent sheet piling sections to form a plurality of joints. These joints are welded so that the plurality of joints are substantially watertight.

The first floor, the upper chamber floor, the bottom chamber floor and the bottom chamber ceiling are preferably made of concrete. The first floor in the first area has at least one opening for accessing the upper chamber, and the bottom chamber ceiling in the second area has at least one opening for accessing the bottom chamber. Prior to forming a bottom floor in the excavated second area, a plurality of holes can be excavated to an elevation below the predetermined depth and a plurality of structural supports can be installed in the plurality of holes. The structural supports are secured in place by foundations, which are preferably formed using poured concrete. The plurality of structural supports provide support for the bottom chamber ceiling.

In a preferred embodiment, an underground structure is constructed using a method that includes the steps of: (a) installing a plurality of sheet piling sections in the ground to form a wall below grade level, which substantially encloses a first area and a second area; (b) excavating a plurality of holes in the first area to an elevation below a predetermined depth; (c) excavating the second area to the predetermined depth; (d) installing a plurality of first area structural supports in the plurality of holes; (e) leveling the first area; (f) forming a first floor in the first area; (g) excavating the first area to form a first area chamber having a bottom surface; (h) leveling the bottom surface of the first area chamber; (i) forming a first area chamber floor; (j) repeating steps (g) through (i) until a plurality of first area chambers are formed having a plurality of first area chamber floors; (k) installing a plurality of second area structural supports; (l) forming a bottom floor in the excavated second area; (m) forming a ceiling above the bottom floor to form a second area chamber; and (n) repeating step (m) until a plurality of second area chambers are formed having a plurality of second area chamber ceilings. The first area chambers connect to the second area chambers to form a plurality of continuous levels in the underground structure.

A plurality of openings are provided in the first floor, the first area chamber floors and the second area chamber ceilings to provide access to the first area chambers and the second area chambers. The plurality of first area structural supports provide support for the first floor and the plurality of first area chamber floors, while the plurality of second area structural supports provide support for the plurality of second area chamber ceilings. Preferably, the first area chambers and the second area chambers are formed simultaneously to minimize the amount of time needed to complete the construction. However, the first area chambers can be constructed first so that the excavation in the second area can be used to access and excavate under the floors of the first area.

A plurality of floor supports can be attached to the interior surface of the sheet piling wall. The first floor, the upper chamber floors, the bottom chamber floor and the bottom chamber ceilings at least partially contact the wall and are attached to one or more floor supports. The plurality of sheet piling sections that form the wall interconnect with adjacent sheet piling sections to form a plurality of joints, which can be welded so that they are substantially watertight. Each of the first area structural supports has a plurality of floor supports for attaching the first floor and the first area chamber floors and each of the second area structural supports has a plurality of floor supports for attaching the second area chamber ceilings. When the construction of the underground structure is completed, the first area chamber floors correspond to and connect to the second area chamber ceilings to provide a continuous floor between the first area chambers and the corresponding second area chambers.

BRIEF DESCRIPTION OF THE FIGURES

Other objects and many attendant features of this invention will be readily appreciated as the invention becomes better understood by reference to the following detailed description when considered in connection with the accompanying drawings wherein.

DETAILED DESCRIPTION OF THE INVENTION

Figure 1:
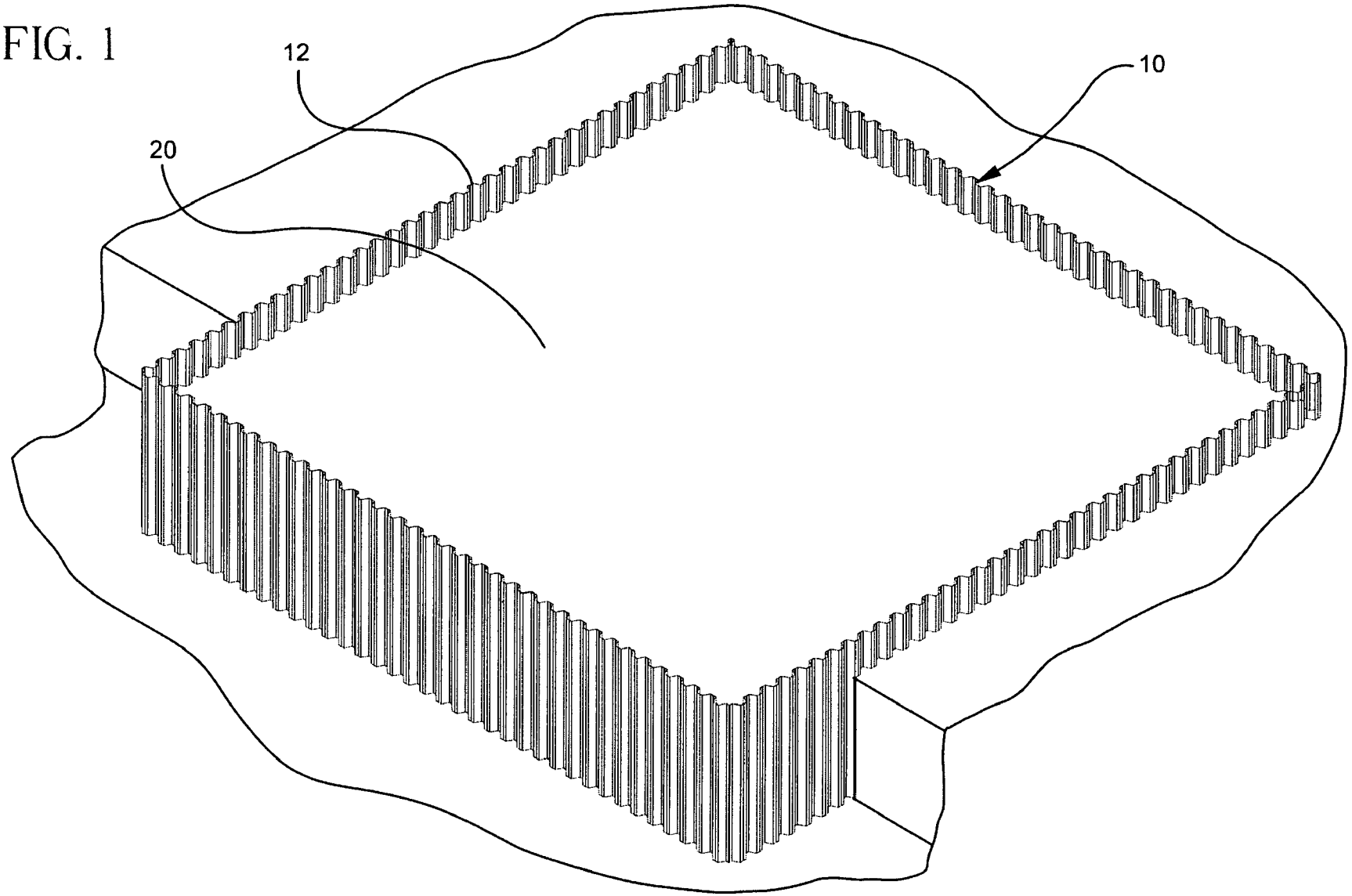
FIG. 1 is a perspective view of the sheet piling wall installed around the perimeter of the construction site.

The method of the present invention shortens construction times by allowing the construction of the above ground superstructure to begin before the below ground construction is completed. The method uses sheet piling sections (also referred to herein as "sheet piles" or "sheet piling"), preferably AZ series sheet piling, to form a wall around the perimeter of the structure that is being built in place of a traditional concrete foundation wall. The support columns are then installed within at least part of the area bounded by the sheet piling wall and a ground level floor is installed (typically a concrete slab) before the below ground area of the structure is excavated. This allows the excavation below the ground level floor and the above ground construction to proceed simultaneously. In addition, the method provides easy and cost efficient construction of below grade structures with dry environments by forming the sheet piling wall before excavating. This minimizes the amount of ground water that enters the site and that has to be removed during excavation.

After the construction site has been cleared and graded, the sheet piles are installed to form a wall around the perimeter of the structure. The sheet piling wall can be continuous and completely enclose an area. However, the sheet piling sections do not have to form a continuous perimeter wall around the construction site and, as described in more detail below, some embodiments of the method can have openings in the wall for access to the area enclosed by the wall. In addition, one or more sides of the perimeter sheet piling wall can be formed by an existing structure, such as the foundation of an adjacent building or underground structure. The sheet piling wall is formed by driving sheet piles into the ground using any of the well known methods for installing sheet piling. Preferred methods are step panel driving using a template, hydraulic rig-mounted vibratory or impact hammers or state of the art noiseless and vibrationless press in hammers. These methods ensure proper alignment of piles to within structural tolerances.

The sheet piling wall forms a perimeter that encloses the area for the construction site, i.e. the "foot print" for the building or structure that is being constructed. The surface of the sheet piling wall that faces the enclosed area is referred to as the interior surface and the surface of the sheet piling wall that faces away from the enclosed area is referred to as the exterior surface. The sheet piling can be formed from a wide variety of different types of sheet piling sections, which are well known to those skilled in the art, although AZ series sheet piling sections manufactured by Arcelor SA or Arcelor International America LLC are preferred. The joints between the sheet piling sections can be either welded or sealed with a sealant material to form a waterproof barrier. In preferred embodiments, the sheet piling sections are coated with a fire retardant material.

The present invention uses conventional methods for installing sheet piling sections, which are well known to those skilled in the art. Typically, the sheet piling sections are sheets of steel with a length greater than the width and a thickness of between 0.375 and 0.787 inches (i.e., between ⅜ and ¾ inches). The sheet piling sections are installed in the ground with the length of the section oriented vertically. Accordingly, the sheet piling sections are substantially straight along their length to facilitate insertion in the ground. In the direction of the width, the sheet piling sections can be straight or have a variety of shapes to provide added structural strength. However, the dimensions and shapes of the sheet piling sections are not critical and the particular type, size and/or shape of the sheet piling section selected is not intended to limit the invention in any way.

The materials excavated are referred to as "spoils" and can include soil, sand, mud, rocks, debris and various other materials. The invention contemplates that the spoils can include any type of sub-surface material and the spoils can vary greatly depending on the location of the construction site. However, the composition of the spoils excavated does not limit the scope of the invention. Methods and techniques used for excavation will depend on the composition of the spoils encountered for any particular project and are well known by those skilled in the art.

As used herein, the term "concrete" is intended to include different types of concretes, cements and pozzolanic materials that are used in the construction of buildings and parking garages. One of ordinary skill in the art will understand that the selection of the "concrete" depends on a number of different factors, such as geographic location, geological conditions, climate, design requirements of the project and the particular use (whether the concrete is being used to form a foundation, column or floor), as well as availability and cost factors. The "concrete" that is used in the construction of the structures of the present invention is not intended to limit the scope of the invention in any manner.

In one embodiment, the method includes installing a plurality of sheet piling sections in the ground to form a below ground wall which substantially encloses an area; forming a floor for at least part of the area; and excavating under the floor to form a chamber. Preferably, the floor is concrete and at least partially contacts the sheeting piling sections. This method is referred to herein as "top-down" construction. Using the top-down construction method, a series of chambers can be formed by sequentially pouring a concrete floor and excavating under it to form a plurality of chambers. In contrast, conventional "bottom-up" construction methods excavate an area to the lowest point of the underground structure and construct a foundation. The underground construction then proceeds upwardly from the foundation (i.e., the bottom) to the ground level.

The top-down method of construction does not require the sheet piling walls to have exterior anchors for support because the excavation does not begin until after a permanent ground level surface or floor, preferably a concrete slab or a plurality of adjoining concrete slabs, has been formed in the area inside the sheet piling wall. This ground level surface directly or indirectly (when insulation or a material that allows for expansion is installed between the concrete slab and the wall) contacts the interior of the sheet piling wall to secure the sheet piling in place and to provide structural support. The concrete floor transfers and balances the forces exerted by the ground on the opposing sides of the wall so that the wall does not collapse inwardly when the area enclosed by the sheet piling wall is excavated. As the construction proceeds from the ground level downwardly, additional concrete floors are formed which provide additional support for the sheet piling wall.

In a preferred embodiment, the top-down method of construction is carried out in only part of the area enclosed by the sheet piling sections. This area is interchangeably referred to herein as the "first area" or the "priority area." The priority area is usually the area of the cite where the critical high rise building(s) or the "critical path" construction is located and where it is desirable to begin the erection of the building frame (or superstructure) as early in the construction schedule as possible. When the building occupies only part of the site area enclosed by the sheet piling wall, top-down construction can be used under the critical path building footprint and open-cut excavation can be used for the "second area" or "lower priority area." A concrete slab formed in the first area is enclosed on three sides by the sheet piling wall and the fourth side is an "open side," which borders on the "lower priority area." The erection of the building above the concrete slab in the priority area can begin, while construction of chambers under the ground level slab in the priority area and excavation in the second area proceed simultaneously.

The second area can be excavated in stages corresponding to the construction of the levels in the first area. After a floor is constructed in the first area, the second area is excavated to a point below the floor so that the area under the floor can be excavated "horizontally" from the second area. In another embodiment, the area below the floor in the first area is "vertically" excavated through one or more openings in the floor. For underground parking structures, these openings can correspond to the openings for the ramps that provide access between the floors or levels.

The construction in the second area (i.e., the lower priority) can proceed in several different ways. First, the construction can be delayed until later in the construction schedule, preferably after the construction in the first area is completed. Second, the second area can be excavated in stages corresponding to the progress in the first area to allow easy access for excavating the first area. Construction of chambers in the second area does not begin until the construction in the first area is completed. Third, the second area can be excavated and construction of chambers carried out simultaneously with the construction in the first area. For all three scenarios, construction in the second area is carried out using the "bottom-up" construction method. Columns and foundations are installed and a concrete floor is poured at the bottom of the open excavation in the second area. Scaffolding is used to construct ceilings above the bottom concrete floor and form chambers connecting to the chambers in the first area. The ceilings are constructed and the chambers are formed sequentially, as construction proceeds from the floor of the excavation upwards to ground level.

The construction method that uses "top-down" construction in the first area and "bottom-up" construction in the second area is referred to herein as "the hybrid construction method" or "hybrid construction." The hybrid construction method allows all, or a substantial portion, of the area of the building foot print to be optimized by installing the sheet piling wall close to the perimeter of the property. Sheet piling sections driven into the ground do not require any supports, footings or foundations in areas of the construction site where the top-down construction method is used. For the hybrid construction method, the ground level concrete slab does not cover the entire area enclosed by the sheet piling wall and only covers the priority area, and not the secondary area. In most cases, the priority area is about one half or less of the area within the perimeter of the sheet piling wall. However, this is not a limitation to the present invention and the priority area can be any size.

After the perimeter sheet piling wall is installed and before the permanent ground level surface (i.e., the concrete slab) is constructed in the priority area, temporary steel casings are driven into the ground. These casings are long hollow steel tubes that are, preferably, driven into the ground using well known pile driving methods and equipment. The casings are used to install structural supports or columns for the superstructure loading in the priority area and, when in place, the bottom of the casing extends below the bottom of the installed structural support. After a casing is driven into the ground to a predetermined depth, the spoils inside the casing are removed, preferably using an auger, and structural supports in the form of prefabricated columns are installed. Preferably, the columns are made of steel, but other materials, such as concrete or a combination of concrete and steel, can be used. When the columns are formed from steel I-beams, the temporary steel casings are driven into the ground below a specified column pile tip elevation, i.e., a depth that is a predetermined distance below the grade elevation for the structure. As used herein, the term "grade" refers to the ground level, i.e., the "zero elevation" or vertical reference point for a project. When the ground is uneven, the grade can be arbitrarily set as a point of reference for the construction design or it can be selected based on the ground elevation of the completed project.

A concrete foundation for the base of the column is formed either by placing the column into the concrete or pouring concrete around the column after it is positioned in the casing. In a preferred embodiment, the steel columns have a plurality of steel members or studs extending outwardly from the surface of the column near the base, which provide a structural connection between the base of the column and the concrete. After the concrete hardens, the temporary steel casing is removed and the sequence is repeated until all of the columns are installed. The steel casings can be reused a number of times to reduce material costs.

The columns have brackets located at intervals along their lengths corresponding to the elevations of the floors in the underground structure, which are used to support the floor, preferably concrete slabs, either preformed or poured at the site. When the columns are installed in the casings, they are set to precise elevations for the accurate placement of the brackets that support the floor. All of the columns and brackets must be accurately positioned so that the floors of the chambers are substantially level or slope at the angle specified in the design. Preferably, the preformed concrete slabs or the rebar supports for the poured concrete are connected to the brackets on adjoining columns, as well as at different points on the interior surface of sheet piling walls. Expansion devices can be used to compensate for expansions and contractions of the concrete floors, the sheet piling and the surrounding ground due to changes in temperature and soil conditions (e.g., the surrounding soil may become saturated from heavy rainfall and exert a greater force against the exterior walls of the sheet piles). In addition, plates are attached to the top of the columns for connecting to and supporting the above-ground structure (i.e., the superstructure) of the building.

In the second area, the bottom-up construction method is used and the support columns are installed using conventional construction methods. Preferably, after the second area is excavated to the desired depth, holes for the columns are dug in the floor of the excavation and concrete foundations are poured. The columns can be set in place before the concrete is poured or, when the columns have multiple sections, the base section of the column can be formed with the foundation and the other sections can be attached after the concrete has hardened. After the columns and any underground pipes (e.g., drainage pipes) or other utilities are installed, the bottom of the excavation is graded and a bottom floor is installed, preferably a poured concrete floor. The construction in the second area proceeds upwardly from the bottom of the excavation by forming a series of floors above the bottom floor.

After the sheet piling wall is completed and the columns are installed in the priority area, the ground is leveled and a 1-inch to 6-inch thick slurry mud mat is poured, preferably about 3 inches thick. The mud mat is leveled and a barrier layer, preferably plastic or cardboard sheets, most preferably polyethene sheets, is placed over the mud mat. Steel reinforcement for the concrete (e.g., rebar) is placed on top of the barrier layer. After the steel reinforcement is installed and, preferably, connected to the columns and side walls of the sheet piling, the concrete slab is poured and leveled to form the floor of the ground level. Since the ground level slab is poured on top of the ground before the lower levels are excavated, the amount of form work needed is minimized. If the ground level slab were formed after the excavation was completed, the floor would be constructed above an open space and forms would have to be constructed to support the floor until the concrete hardened.

One or more access holes are provided in the concrete floor to allow air circulation and excavation under the slab for formation of the lower levels. After the concrete of the ground level slab hardens, excavation can begin. When preformed concrete slabs are used to form the floor, there is no need to wait for the concrete to harden and excavation below the floor can begin immediately. Initially, the openings in the slab are excavated to a predetermined level and then the area under the slab is excavated. The barrier layer under the concrete slab prevents the slurry mud mat from adhering to the poured concrete slabs. As excavation under the slab progresses, the slurry and barrier layer are easily removed, leaving a smooth surface on the under side of the poured concrete slab, which forms a ceiling for the chamber that is excavated.

When the hybrid construction method is used, excavated spoils in the priority area can either be removed through the access hole(s) in the concrete slab or laterally, through the excavation in the second area. Even though the method of excavation for top-down construction is slow compared to open cut excavation, the below ground construction in the priority area is completely removed from the critical path of the construction schedule. This allows the superstructure build to begin as soon as the sheet piling wall, the columns and the ground level concrete slab are in place. The below grade excavation proceeds independently, at its own pace, removed from the critical path of the overall construction schedule. Moreover, by accessing the priority area from the second area, the area under the critical path building can be kept clear so that the underground construction is totally segregated from, and does not interfere with, the above ground construction.

When the excavation of a level in the priority area is completed and a chamber is formed, a concrete slab floor, similar to the ground level concrete slab, is constructed using the same method. Preferably, the floor of the chamber is graded, a slurry mud mat is laid on the surface and covered with a barrier layer material, steel reinforcements for the concrete slab are constructed on top of the barrier layer and connected to the brackets on the steel columns and the floor supports on the sheet piling walls, and then the concrete is poured. A second chamber is then formed by excavating the ground under the first chamber and pouring a concrete floor. These same steps are repeated as successive levels are excavated and successive chambers are formed. The top-down construction continues in the priority area until a predetermined number of chambers (also referred to herein as "levels") have been constructed. After the construction of the underground chambers is completed, access to the chambers from the ground level can be provided by a combination of staircases, elevators and/or ramps.

In some embodiments, force absorbing materials and/or devices (such as caulking and expansion joints) are placed between concrete slabs and columns and/or the sheet piling wall to allow for expansion. When the floor is formed using preformed concrete slabs, force absorbing materials can also be placed between the slabs to allow for expansion and prevent the concrete from cracking. The preformed concrete slabs can have connectors around the edges at locations corresponding to the sheet piling wall supports and the column supports. The preformed concrete slabs are lowered into the chamber and the connectors are connected to the supports on the walls and columns. The use of preformed concrete slabs is particularly preferred for the bottom-up construction in the second area, since it obviates the need for constructing forms at each level for poured concrete ceilings/floors. In addition, connecting the floors of the chambers to the sheet piling wall reduces or eliminates the need for shoring or supports on the exterior of the walls, since the floors carry the loading for the forces acting on the exterior surface of the sheet piling wall.

In the hybrid construction method, the ground level concrete slab does not cover the entire area enclosed by the sheet piling wall and only covers the priority area. The area that is not covered by the concrete slab is the secondary area, where above ground construction is not on the critical construction path. Typically, the priority area is the portion of the site where above ground construction is on the critical path of the construction schedule. The hybrid method allows the construction to begin immediately for buildings, which are scheduled to take more time to complete. In most cases, the priority area is about one half or less of the area within the perimeter of the sheet piling wall. However, this is not a limitation to the present invention and the priority area can be any size. After the concrete slab hardens, the ground in the secondary area is preferably excavated (referred to herein as the "open excavation") to a depth approximately equal to the floor level of the first underground chamber. This exposes the ground under the concrete slab and allows the excavation of the spoils under the slab to be carried out from the side, instead of through an opening in the slab. After the ground under the slab is excavated, a chamber with a concrete slab floor is formed as described above. The open excavation resumes and the depth of the excavation increases until it reaches the approximate level of the floor of the next chamber. A second chamber is then formed by excavating the ground under the first chamber and pouring a concrete floor. The top-down construction continues in the priority area until a predetermined number of chambers (also referred to herein as "levels") have been constructed.

After the concrete slab hardens, construction can begin in the second area. The ground in the secondary area is preferably excavated (referred to herein as the "open excavation") to a depth approximately equal to the floor level of the first underground chamber. This exposes the ground under the concrete slab in the priority area and allows the excavation of the spoils under the slab to be carried out from the side, instead of through an opening in the slab. After a chamber floor is formed in the first area, the second area is excavated to a level corresponding to the next chamber floor that will be formed in the first area. The ground in the secondary area continues to be excavated at a pace which corresponds with the construction in the priority area until the construction of the chambers in the priority area is completed. In another embodiment, construction in the second area proceeds independently from the construction in the priority area. Constructing the first area chambers and the second area chambers simultaneously can reduce the construction time for some projects.

After the second area is excavated to a predetermined depth, the bottom of the excavation is leveled and a plurality of concrete columns and their foundations are installed as described above. A concrete slab is then laid to form a bottom floor, which is aligned with the floor of the lowest chamber in the priority area. Construction of additional chambers/levels above the bottom floor in the open excavation of the second area then proceeds. Forms can be constructed and concrete poured for floors or preformed sections (preferably concrete sections) can be attached to the columns to construct the floors. Bottom-up construction continues until a plurality of chambers/levels have been constructed from the bottom of the excavation to ground level. These chambers/levels correspond and connect to the chambers formed using the "top-down construction" method in the priority area. Stairwells, elevators and vehicle ramps between the chambers/levels and ground level are provided as needed. When the below ground construction is completed, each of the corresponding chambers formed by "top-down construction" and "bottom-up construction" form a single continuous level.

The sheet piling wall does not have to extend around the entire perimeter of the construction site. Instead, one or more openings can be provided in the wall or in places where sheet piling sections have not been installed. On the exterior side of the sheet piling wall adjacent to these openings, the ground is excavated to allow easy access to the openings. When the areas inside the sheet piling wall are excavated, the openings are used to remove the spoils. These openings allows heavy equipment, such as excavators and dump trucks to freely enter and leave the area enclosed by the sheet piling wall. The side entry into the chambers is also more convenient because excavating through the openings in the concrete slab can interfere with the construction of the superstructure. After the excavation is completed, sheet piling can be installed in the openings and the excavation next to the wall can be backfilled.

After the construction of the underground chambers is completed using any of the methods described above, the sheet piling wall and columns are cleaned and a coating, preferably a latex paint or polymer-based paint that is resistant to rust, is applied. The sheet piling wall is substantially continuous around the perimeter of the structure but it can have openings that serve a variety of different functions. For example, the sheet piling walls can have openings for utilities such as gas, water, electricity, sewage and drainage. The walls can also have openings for underground connections to buildings and other structures. However, the joints between the sheet piling sections are preferably either welded or filled with a sealant to prevent groundwater from penetrating the wall and entering the chambers.

The invention and the various embodiments will now be described in more detail with reference to the accompanying drawings. FIG. 1 shows an overhead view of the construction site with a sheet piling wall 10 around the perimeter of the enclosed area 20. The sheet piling wall 10 is formed by a plurality of sheet piling sections 12 that are sequentially driven into the ground. The wall 10 is supported by the ground on both sides and, therefore, does not require any foundation or lateral supports. The area 20 enclosed by the sheet piling wall 10 is selected based on the building "footprint." Although a rectangular area 20 is shown in FIG. 1, the method is not limited by the shape of the perimeter sheet piling wall 10 and the wall 10 can have a variety of different shapes. In addition, the sheet piling wall 10 does not have to entirely enclose the area 20. For example, one or more sides of the enclosed area can be formed by an existing structure, such as the foundation of an adjacent building.

Figure 2:
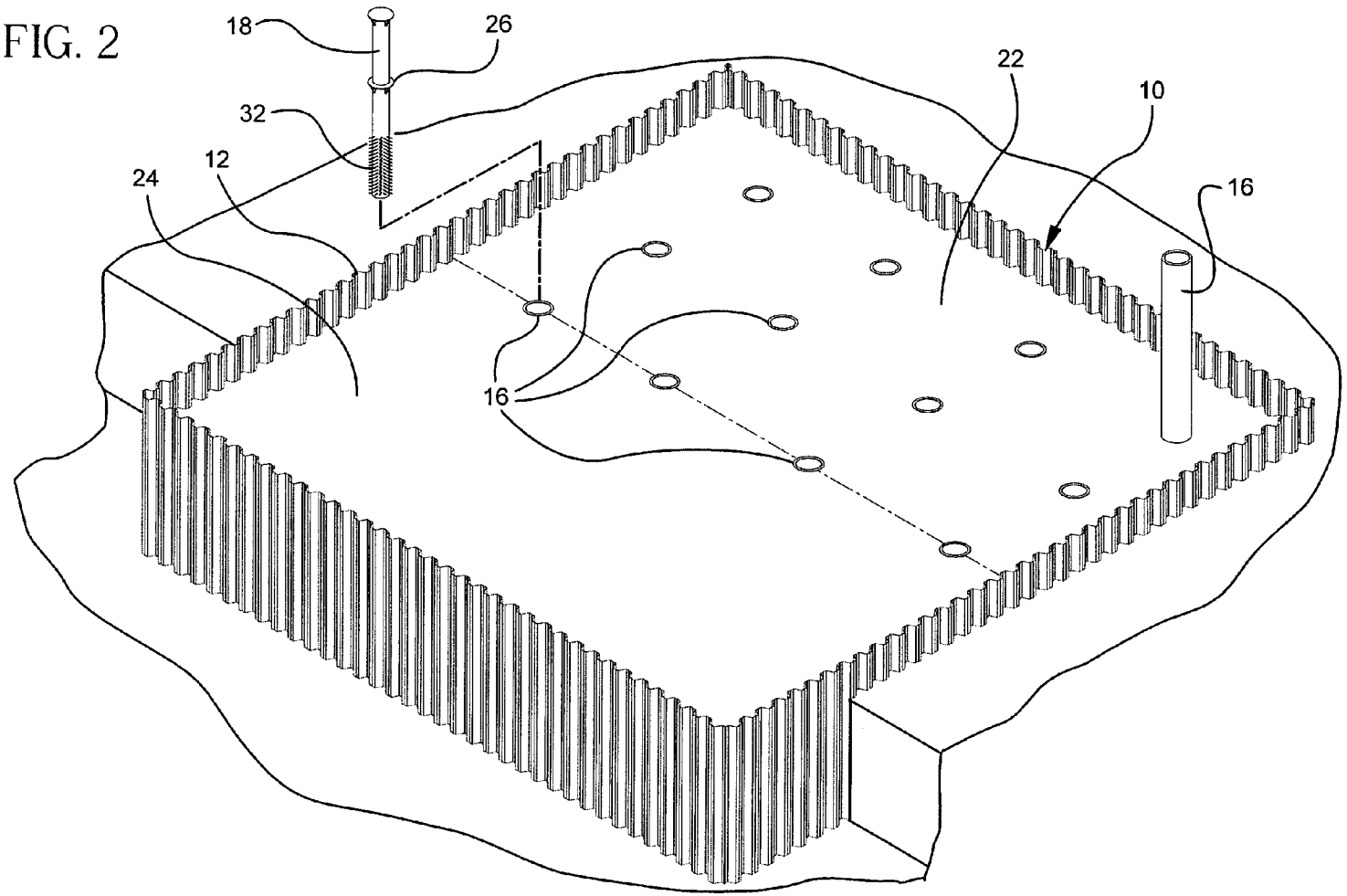
FIG. 2 is a perspective view of a hybrid method of construction with the area enclosed by the sheet piling wall divided into two construction areas.

FIG. 2 shows an embodiment of the present invention wherein an underground structure is constructed using sheet piling sections and the hybrid method of construction. The enclosed area 20 of FIG. 1 is divided into two areas, a first or priority area 22 and a second area 24. A top-down construction method is used in the first area 22 and a conventional bottom-up construction method is used in the second area 24. After the sheet piling wall 10 is installed, work begins by installing a plurality of steel casings 16 in the first area 22. After a casing 16 is installed to a predetermined depth, the spoils inside the casing 16 are removed, preferably using an auger (not shown). A steel column 18 is then lowered into the hollowed out casing 16 and secured at a predetermined elevation, while concrete is poured into the casing 16 to form a foundation 28 (see FIG. 4). The steel column 18 has a plurality of studs 32 that extend from the surface of the column 18 and secure the column 18 in the concrete foundation 28. After the concrete has hardened, the casing 16 is removed and can be reused.

The steel columns 18 also have one or more brackets 26 which are used to attach the floors to the columns 18. The brackets 26 are carefully positioned so that the brackets 26 for each floor are aligned to ensure that the floors are level. When the steel column 18 is properly positioned so that the brackets 26 are at the proper elevation, cement is poured into the bottom of the casing 16 to form a foundation 28, which secures the steel column 18 in place. The procedure is repeated until casings 16 for all of the steel columns 18 required for the structure are installed.

Figure 3:
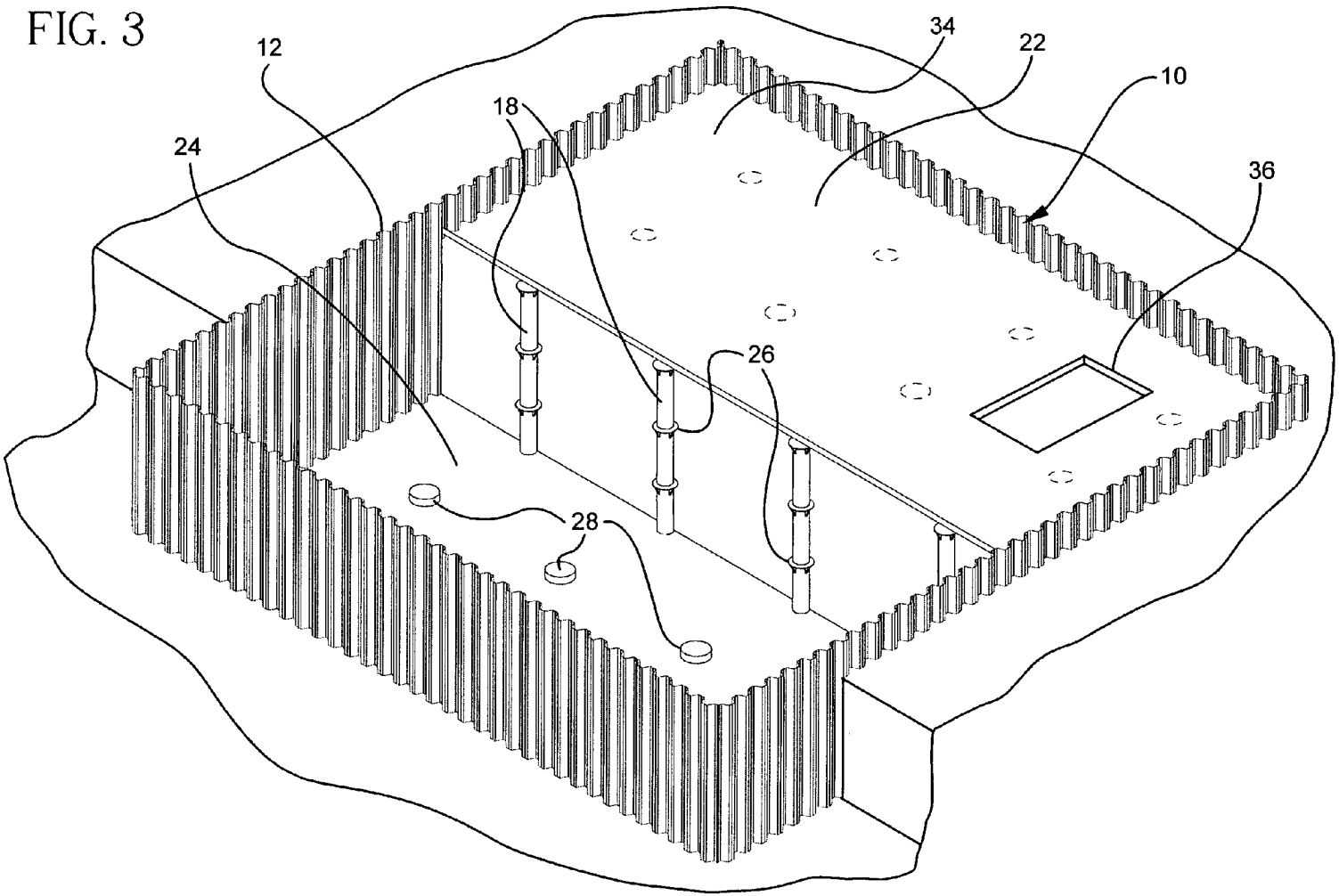
FIG. 3 is a perspective view of a hybrid method of construction with top-down construction used in a first area and bottom-up construction used in the second area.

FIG. 3 shows a plurality of steel columns 18 installed in the first area 22 enclosed by the sheet piling wall 10. The second area 24 is excavated and a plurality of foundations 28 formed at the bottom of the excavation. These foundations 28 are used to support a plurality of steel columns 18 (see FIG. 5) that are erected in the open excavation of the second area 24. The construction in the first area 22 and the second area 24 is carried out simultaneously. After the concrete slab 34 is formed in the first area 22, the construction below the slab 34 proceeds through the opening 36 in the slab 34. At the same time, construction of the above ground structure 60 (see FIG. 6) can begin. Although the second area 24 is shown as fully enclosed by the sheet piling wall 10, in some embodiments of the method, the sheet piling wall 10 can have one or more openings so that trucks and other construction equipment can easily access the excavation.

Figure 4:
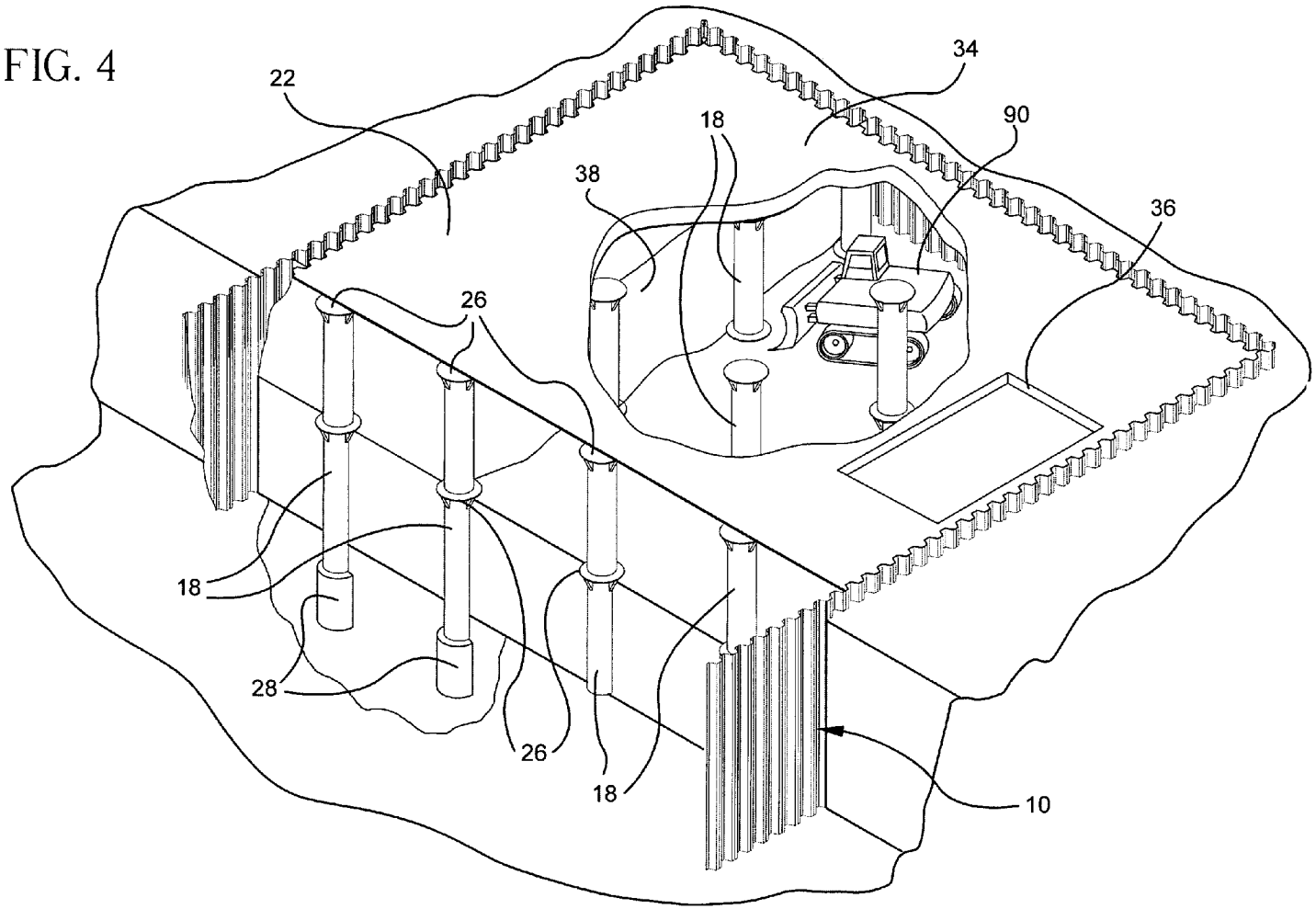
FIG. 4 is a perspective view of the top-down construction method showing the excavation carried out under the ground level concrete slab.

FIG. 4 shows the top-down construction in the first area 22. After all of the columns 18 are installed in the first area 22, the surface is leveled and a mud mat is laid down. The mud mat is then covered with a barrier material, preferably polyethylene sheets, and steel reinforcing (rebar). A concrete slab 34 is then poured and an opening 36 is formed in the slab 34 to allow access for excavation under the slab 34. The opening 36 provides access to the space below the slab 34 so that excavating equipment 90 can remove soil and other material to form a chamber 38. The excavation of the chamber 38 continues until the entire area under the slab 34 between the sheet piling walls 10 is excavated to a predetermined depth. The depth can vary depending on the intended use of the structure. For parking garages, the depth is typically selected so that the distance between levels is between 10 and 16 feet. As the chamber 38 is excavated, the mud mat and barrier layer material installed under the ground level concrete slab 34 are removed to uncover a smooth concrete ceiling for the chamber 38. The floor of the chamber 38 is then graded and another mud mat is laid down and covered with a barrier layer material. Steel reinforcement is installed and concrete is poured to form a second concrete slab 40 (see FIG. 5) in the same manner that the ground layer concrete slab 34 was formed. One or more openings are formed in the concrete slab 40 so that the space below the slab 40 can be excavated to form a chamber 50 and a third concrete slab 46 installed. This procedure continues until all of the chambers 38, 50, 52, 54 (see FIG. 5) in the first area 22 are constructed.

Figure 5:
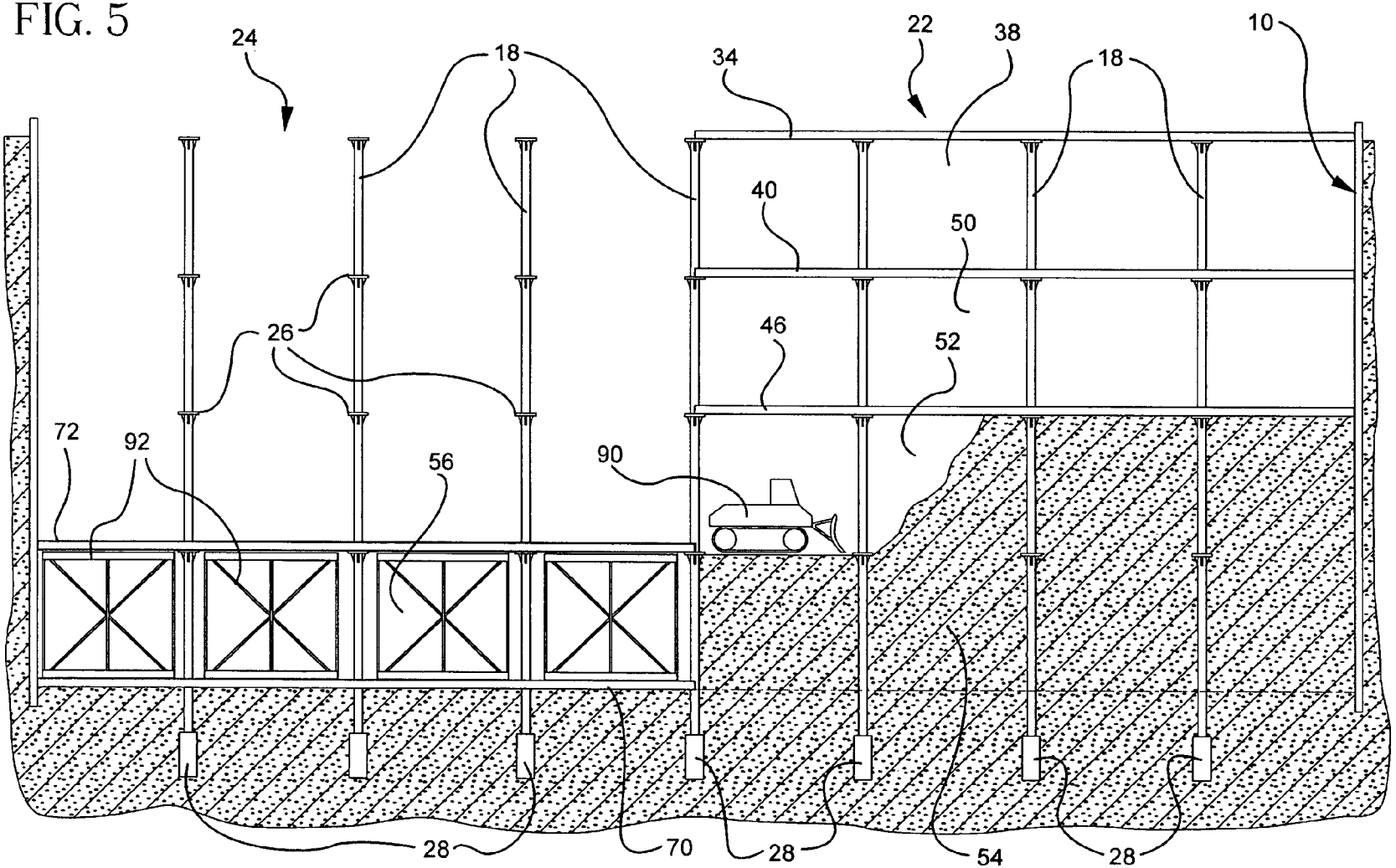
FIG. 5 is a side view of the hybrid method of construction with top-down construction used in a first area and bottom-up construction used in the second area.

FIG. 5 is a side view of the underground construction in the first area 22 and the second area 24. The top-down construction method is used in the first area 22 and two chambers (or levels) 38, 50 and chamber floors 40, 46 have been formed. The third chamber 52 is being excavated using excavating equipment 90 and the floor has not been formed. Construction of the fourth chamber 54 has not started. In the second area 24, the bottom-up construction method is used. A plurality of steel columns 18 are erected and the bottom floor 70 is formed. Scaffolding 92 is erected in the second area 24 for supporting forms that are used for the construction of the ceiling 72 of the bottom chamber (or level) 56. FIG. 5 shows how the construction in the first area 22 proceeds downwardly, while the construction in the second area proceeds upwardly. When the construction is completed, the floors of the corresponding chambers (i.e., levels) connect to form continuous levels of the underground structure.

Figure 6:
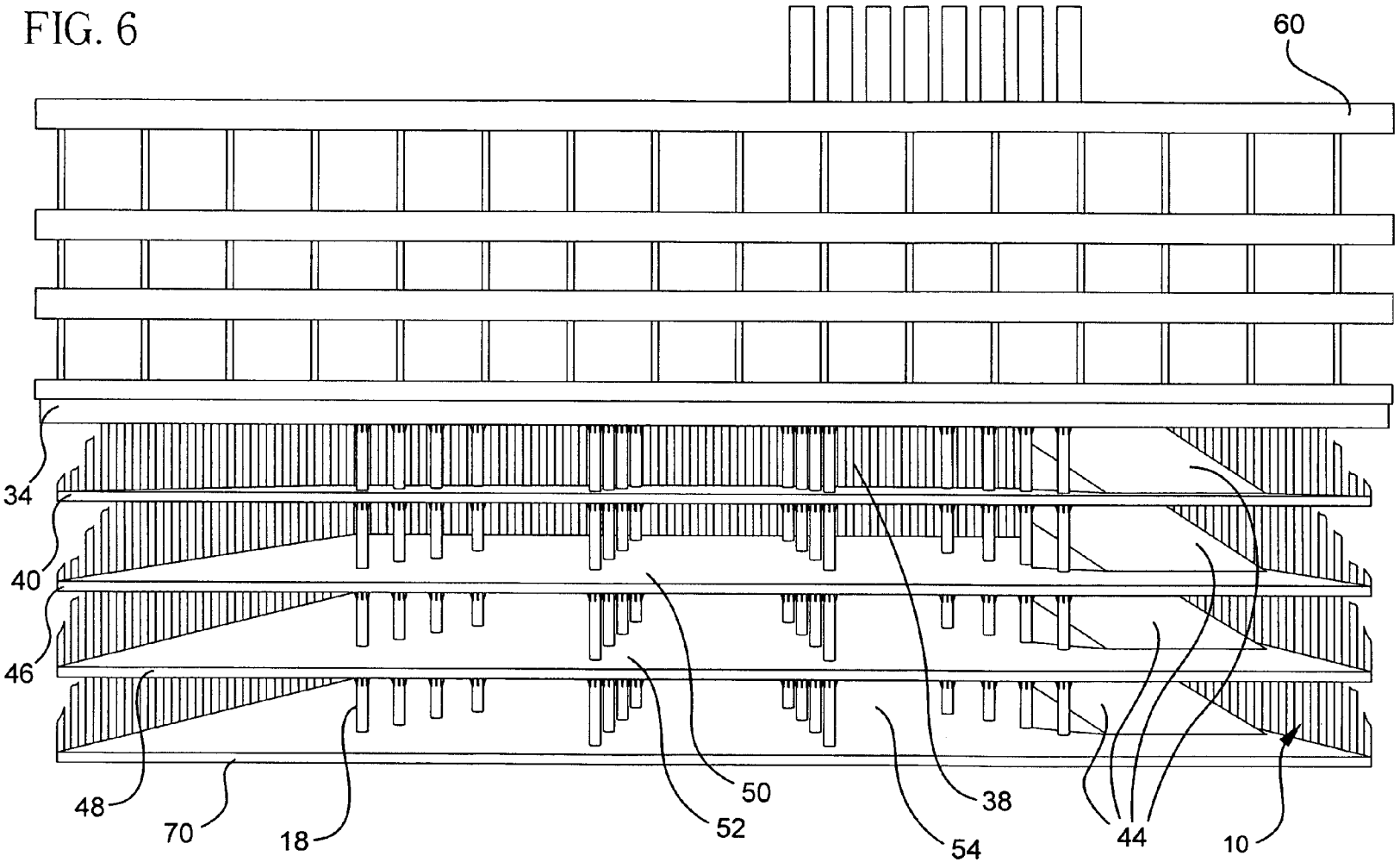
FIG. 6 shows the completed structure with three underground chambers connected by ramps.

FIG. 6 shows a completed project, which includes the above-ground superstructure 60 and four underground chambers 38, 50, 52, 54 connected by ramps 44. For increased safety and in order to comply with building codes, fire rated sheet piling sections can be used. The walls 10 formed by the sheet piling sections 12 can be made watertight by seal welding the locks (i.e., the joint between adjoining sheet piling sections 12) or by sealing the locks with sealant material. Seals can also be formed between the concrete slabs that form the floors 34, 40, 46, 48, 70 and the sheet piling walls 10. The sealing method can use hydrophilic strips, a water-stop membrane and/or perforated injection hose to inject sealants after the concrete slab is in place.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. A method of constructing an underground structure comprising:

installing a plurality of sheet piling sections in the ground to form a wall below grade level which substantially encloses a first area and a second area;

forming a first floor in the first area;

excavating under the first floor to form an upper chamber;

forming an upper chamber floor;

excavating the second area to a predetermined depth;

forming a bottom floor in the excavated second area; and forming a bottom chamber ceiling above the bottom floor to form a bottom chamber.

2. The method of constructing an underground structure in accordance with claim 1, further comprising:

excavating under the upper chamber floor to form a lower chamber; and forming a lower chamber floor;

wherein the lower chamber floor corresponds to the bottom floor in the excavated second area.

3. The method of constructing an underground structure in accordance with claim 1, further comprising:

forming a top chamber ceiling above the bottom chamber ceiling to form a top chamber, wherein the top chamber ceiling corresponds to the first floor in the first area.

4. The method of constructing an underground structure in accordance with claim 2 further comprising:

forming a top chamber ceiling above the bottom chamber ceiling to form a top chamber, wherein the top chamber ceiling corresponds to the first floor in the first area.

5. The method of constructing an underground structure in accordance with claim 4, wherein a plurality of first area chambers are formed between the first floor and the lower chamber floor and wherein a plurality of second area chambers are formed between the bottom floor and the top chamber ceiling.

6. The method of constructing an underground structure in accordance with claim 1, wherein after installing the plurality of sheet piling sections and prior to forming the first floor in the first area, the method further comprises:

excavating a plurality of holes in the first area to an elevation below the predetermined depth; and installing a plurality of structural supports in the plurality of holes, wherein the plurality of structural supports provides support for the first floor and the upper chamber floor.

7. The method of constructing an underground structure in accordance with claim 6, wherein the excavation of the plurality of holes comprises driving a plurality of casings in the first area and removing spoils from inside the casings, and wherein the installation of the plurality of structural supports comprises pouring concrete into the plurality of casings, after the spoils inside the casing are removed, to form foundations for the plurality of structural supports.

8. The method of constructing an underground structure in accordance with claim 1, wherein the first floor, the upper chamber floor, the bottom chamber floor and the bottom chamber ceiling comprise concrete.

9. The method of constructing an underground structure in accordance with claim 1, wherein the wall has an interior surface and a plurality of floor supports attached thereto, and wherein the first floor, the upper chamber floor, the bottom chamber floor and the bottom chamber ceiling at least partially contact the wall and are attached to one or more floor supports.

10. The method of constructing an underground structure in accordance with claim 1, wherein the plurality of sheet piling sections interconnect with adjacent sheet piling sections to form a plurality of joints, and wherein the plurality of joints are welded so that the plurality of joints are substantially watertight.

11. The method of constructing an underground structure in accordance with claim 1, wherein the first floor in the first area has at least one opening for accessing the upper chamber, and wherein the bottom chamber ceiling in the second area has at least one opening for accessing the bottom chamber.

12. The method of constructing an underground structure in accordance with claim 1, wherein the wall has an interior surface that is at least partially coated after it is exposed by the excavation of the first area and the second area.

13. The method of constructing an underground structure in accordance with claim 1, wherein prior to forming a bottom floor in the excavated second area, the method further comprises:

excavating a plurality of holes in the excavated second area to an elevation below the predetermined depth;

installing a plurality of structural supports in the plurality of holes; and pouring concrete foundations for the plurality of structural supports, wherein the plurality of structural supports provide support for the bottom chamber ceiling.

14. A method of constructing an underground structure comprising:

installing a plurality of sheet piling sections in the ground to form a wall below grade level which substantially encloses a first area and a second area;

excavating a plurality of holes in the first area to an elevation below a predetermined depth;

installing a plurality of structural supports in the plurality of holes;

forming a first floor in the first area;

excavating under the first floor and sequentially forming a plurality of first area chamber floors to form a plurality of first area chambers;

excavating the second area to the predetermined depth;

forming a bottom floor in the excavated second area; and sequentially forming a plurality of ceilings above the bottom floor to form a plurality of second area chambers, wherein the plurality of structural supports provide support for the first floor and the plurality of first area chamber floors.

15. The method of constructing an underground structure in accordance with claim 14, wherein excavating a plurality of holes comprises driving a plurality of casings into the ground and removing spoils from inside the casings, and wherein installing a plurality of structural supports comprises pouring concrete into the casings, after the spoils inside the casing are removed, to form foundations for the structural supports.

16. The method of constructing an underground structure in accordance with claim 14, wherein each of the plurality of ceilings has an opening for accessing the second area chambers.

17. The method of constructing an underground structure in accordance with claim 14, wherein the first floor, first area chamber floors, bottom floor and second area ceilings comprise concrete.

18. The method of constructing an underground structure in accordance with claim 14, wherein the first floor in the first area and one or more of the plurality of first area chamber floors have openings for accessing the first area chambers.

19. The method of constructing an underground structure in accordance with claim 14, wherein the plurality of sheet piling sections interconnect with adjacent sheet piling sections to form a plurality of joints, and wherein the plurality of joints are welded so that the plurality of joints are substantially watertight.

20. A method of constructing an underground structure comprising:

(a) installing a plurality of sheet piling sections in the ground to form a wall below grade level which substantially encloses a first area and a second area;

(b) excavating a plurality of holes in the first area to an elevation below a predetermined depth;

(c) excavating the second area to the predetermined depth;

(d) installing a plurality of first area structural supports in the plurality of holes;

(e) leveling the first area;

(f) forming a first floor in the first area;

(g) excavating the first area to form a first area chamber having a bottom surface;

(h) leveling the bottom surface of the first area chamber;

(i) forming a first area chamber floor;

(j) repeating steps (g) through (i) until a plurality of first area chambers are formed having a plurality of first area chamber floors;

(k) installing a plurality of second area structural supports;

(l) forming a bottom floor in the excavated second area;

(m) forming a ceiling above the bottom floor to form a second area chamber; and (n) repeating step (m) until a plurality of second area chambers are formed having a plurality of second area chamber ceilings, wherein a plurality of openings are provided in the first floor, the first area chamber floors and the second area chamber ceilings to provide access to the first area chambers and the second area chambers, wherein the plurality of first area structural supports provide support for the first floor and the plurality of first area chamber floors, and wherein the plurality of second area structural supports provide support for the plurality of second area chamber ceilings.

21. The method of constructing an underground structure in accordance with claim 20, wherein the first area chambers and the second area chambers are formed simultaneously.

22. The method of constructing an underground structure in accordance with claim 20, wherein the excavation of the first area is done from the excavation in the second area.

23. The method of constructing an underground structure in accordance with claim 20, wherein the wherein the wall has an interior surface and a plurality of floor supports attached thereto, and wherein the first floor, the upper chamber floors, the bottom chamber floor and the bottom chamber ceilings at least partially contact the wall and are attached to one or more floor supports.

24. The method of constructing an underground structure in accordance with claim 20, wherein the plurality of sheet piling sections interconnect with adjacent sheet piling sections to form a plurality of joints, and wherein the plurality of joints are welded so that the plurality of joints are substantially watertight.

25. The method of constructing an underground structure in accordance with claim 20, wherein each of the first area structural supports has a plurality of floor supports for attaching the first floor and the first area chamber floors and each of the second area structural supports has a plurality of floor supports for attaching the second area chamber ceilings.

26. The method of constructing an underground structure in accordance with claim 20, wherein the first area chamber floors correspond to the second area chamber ceilings to provide a continuous floor between the first area chambers and the corresponding second area chambers.

* * * * *